US006752057B2

(12) United States Patent
Oh

(10) Patent No.: US 6,752,057 B2
(45) Date of Patent: Jun. 22, 2004

(54) DEVICE FOR BLANKING OUT PATTERNS

(75) Inventor: Wan-Young Oh, Seoul (KR)

(73) Assignee: DN Craft Corporation, Seoul (KR)

( * ) Notice: Subject to any disclaimer, the term of this patent is extended or adjusted under 35 U.S.C. 154(b) by 0 days.

(21) Appl. No.: 10/105,193

(22) Filed: Mar. 26, 2002

(65) Prior Publication Data

US 2003/0126967 A1 Jul. 10, 2003

(30) Foreign Application Priority Data

Jan. 9, 2002 (KR) ..... 20-2002-0000666

(51) Int. Cl.[7] ..... B26D 5/08; B26F 1/14
(52) U.S. Cl. ..... 83/549; 83/687; 83/691
(58) Field of Search ..... 83/549, 691, 687; 234/109

(56) References Cited

U.S. PATENT DOCUMENTS 549,670 A * 11/1895 Housem ..... 83/549
2,138,543 A * 11/1938 Grappe ..... 83/549
2,458,160 A * 1/1949 Grappe ..... 83/549
4,516,452 A * 5/1985 Dahle ..... 83/455
5,642,569 A * 7/1997 Palmer ..... 33/809
5,697,278 A * 12/1997 Shun-Yi ..... 83/588

* cited by examiner

*Primary Examiner*—Allan N. Shoap
*Assistant Examiner*—Isaac N Hamilton
(74) *Attorney, Agent, or Firm*—Staas & Halsey LLP

(57) ABSTRACT

A device for blanking out patterns of various letters such as Alphabet or figures in a board such as paper includes a housing having a guide groove and through holes on an upper surface thereof, an upper plate having upper pattern holes faced with the through holes, a punch member interposed between the housing and the upper plate, a lower plate combined under the upper plate and having lower pattern patterns faced with the upper pattern holes on an upper surface thereof, a guide rail provided at an upper portion of the housing, and a push handle sliding along the guide rail.

2 Claims, 4 Drawing Sheets

DEVICE FOR BLANKING OUT PATTERNS

BACKGROUND OF THE INVENTION

1. Field of the Invention

The present invention relates to a punching device, and more particularly to a device for blanking out patterns of various letters such as Alphabet or figures in a board such as paper.

2. Description of the Related Art

Generally, a punching device called as 'a puncher' or 'a perforator' has configuration including a through hole of a specific pattern and a punch member passing through the through hole by vertical movement so as to cut out a corresponding area of a sheet material according to the pattern of the through hole.

There are presently manufactured and widespread various types of punching devices. However, when punching several types of patterns, a user should prepare the number of punching devices corresponding to each pattern since one punching device has only one through hole, so causing inconvenience and high costs.

SUMMARY OF THE INVENTION

The present invention is designed with the aim of solving such problems, and an object of the invention is to provide a device for selectively blanking out one of characters or figures having various patterns in one machine unit.

In order to accomplish the above object, the present invention provides a device for blanking out patterns, which includes a housing in a predetermined shape having a guide groove formed along a longitudinal direction of an upper surface thereof and a plurality of through holes arranged at both sides on center of the guide groove; an upper plate positioned under the housing and having upper pattern holes of a predetermined shape faced with the through holes; a lower plate combined to the upper plate with a predetermined gap and having a plurality of lower pattern holes faced with the upper pattern holes of the upper plate respectively; a punch member having a cutting blade at a lower end along an edge thereof and interposed between the through hole of the housing and the upper pattern hole of the upper plate to be slidable through the upper pattern hole; an elastic member to give elastic force to the punch member toward any of the housing and the upper plate; a cap member combined to an upper end of the punch member, an upper surface of the cap member being partially exposed from the housing through the through hole, a marking with same shape as the upper pattern hole being formed on the upper surface of the cap member; a guide rail installed to an upper portion of the housing along a longitudinal direction thereof; and a push handle combined to the guide rail as a pivot axis to slide along the guide rail, the push handle pressing the cap member by rotation.

Preferably, a push protrusion is formed at a lower surface of the push handle to press an upper surface of the cap member by rotation.

In addition, catch grooves may be formed to an inner wall of the guide groove of the housing at a constant interval along a longitudinal direction, and the push handle may include at a lower portion thereof a protrusion of which an end is in contact with the catch groove and an elastic member to give elastic force to the protrusion.

The device for forming patterns of the present invention may further include a support plate combined to the housing with supporting the lower plate, the support plate including supports which are extended upward above the housing and have combining holes formed at both longitudinal ends thereof, and it is also preferably that both ends of the guide rail are combined to the combining holes of the support plate.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 1:
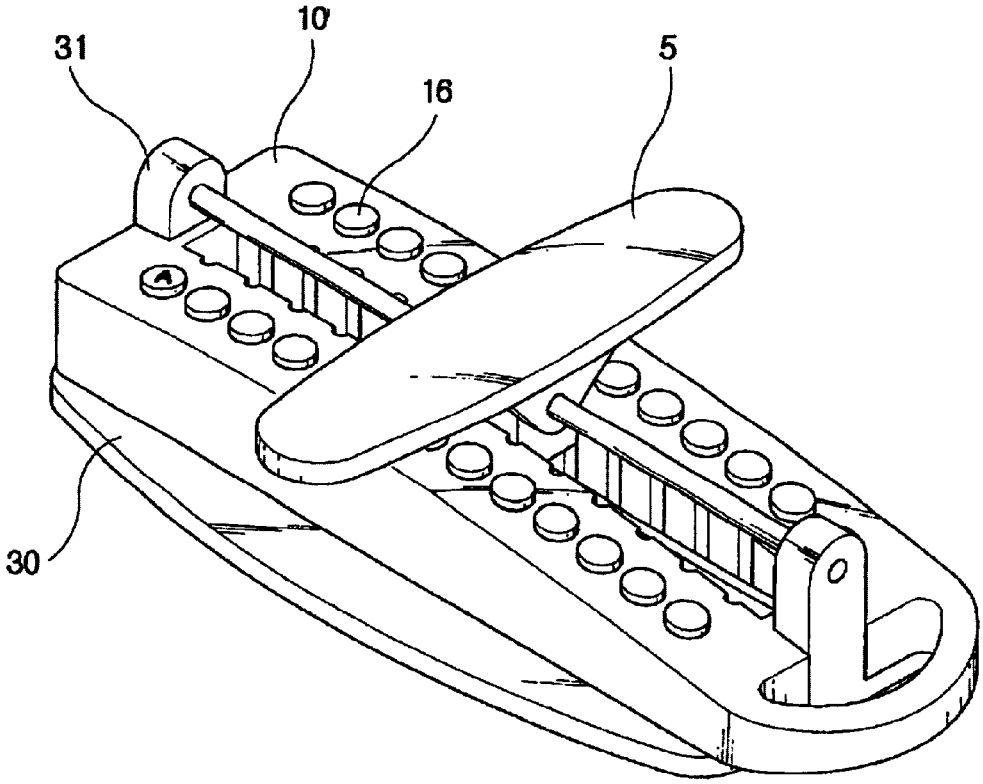
FIG. 1 is a perspective view showing external appearance of a punching device according to the preferred embodiment of the present invention.
Figure 2:
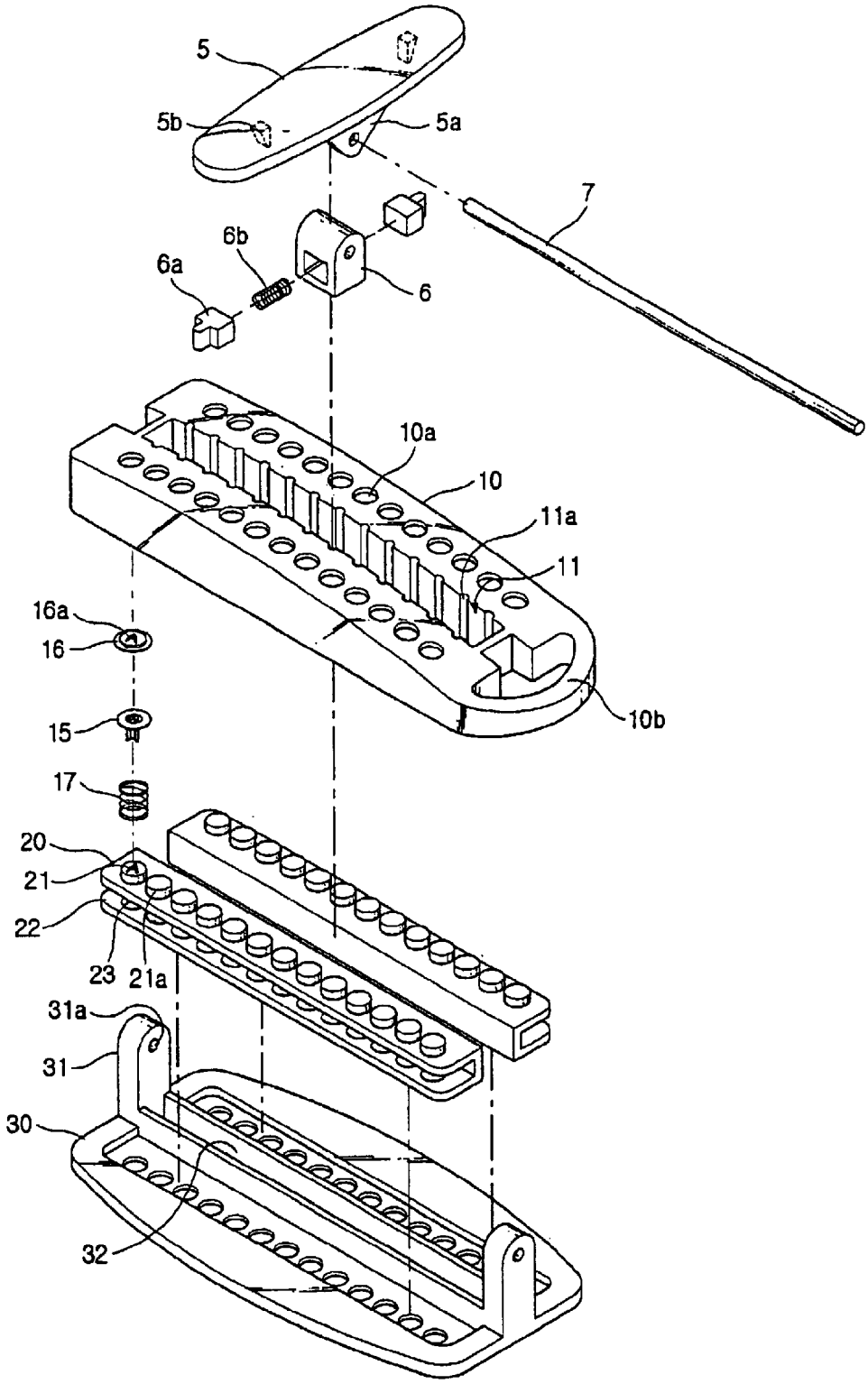
FIG. 2 is an exploded perspective view showing configuration of the punching device according to the preferred embodiment of the present invention.

FIGS. 1 and 2 respectively show external appearance and configuration of a punching device according to a preferred embodiment of the present invention. Referring to the figures, the device of the present invention includes a housing 10 having a guide groove 11 and through holes 10*a* on an upper surface thereof, an upper plate 20 having upper pattern holes 21 faced with the through holes 10*a*, a punch member 15 interposed between the housing 10 and the upper plate 20, a lower plate 22 combined under the upper plate 20 and having lower pattern holes 23 faced with the upper pattern holes 21 on an upper surface thereof, a guide rail 7 provided at an upper portion of the housing 10, and a push handle 5 sliding along the guide rail 7.

The housing 10 may be configured in various shapes. The guide groove 11 is formed on the upper surface of the housing 10 along a longitudinal direction thereof. A plurality of the through holes 10*a* are arranged in two rows at both sides on center of the guide groove 11. In addition, a handle 10*b* is preferably formed at an end of the housing 10 for comfortable carrying and keeping.

At the upper plate 20 combined under the housing 10, a plurality of the upper pattern holes 21, which are shaped in various patterns of for example Alphabet, Hangul (Korean alphabet), number, figure or the like, are formed faced with the corresponding through holes 10*a*.

Figure 3:
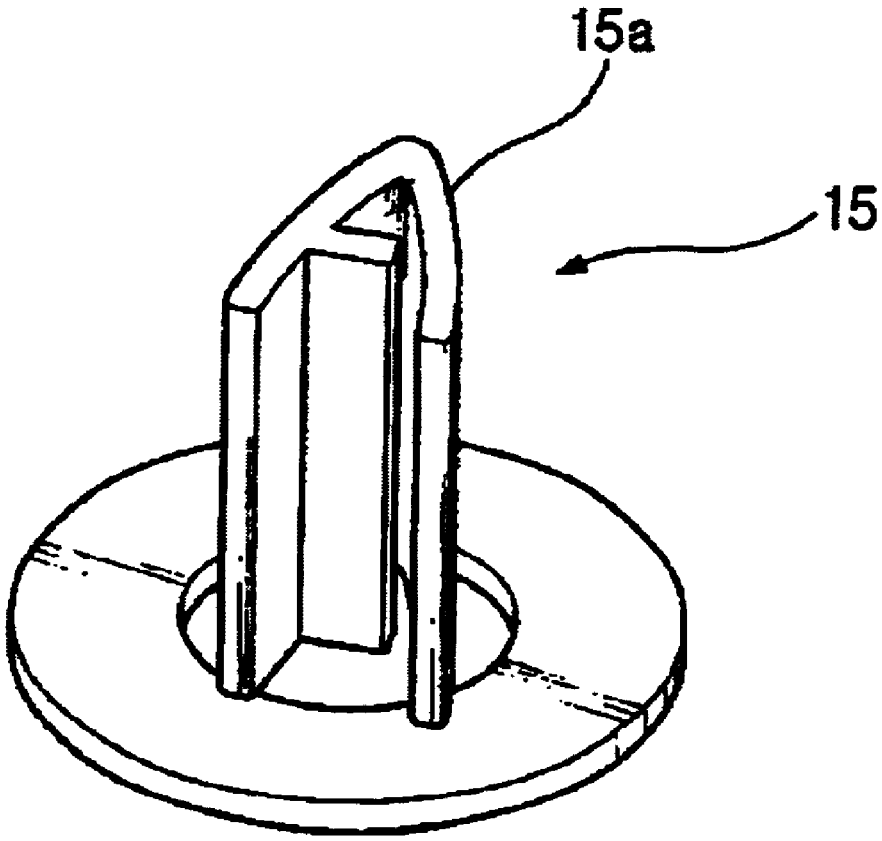
FIG. 3 is a perspective view showing an example of a punch member shown in FIG. 2.

The punch member 15 is interposed between each through hole 10*a* and each corresponding upper pattern hole 21. This punch member 15 is a member passing through the upper pattern hole 21, and preferably has a shape shown in FIG. 3, which has been already proposed in Korea Utility Registration Filing No. 2001-36571 invented by the inventor of this application. In other words, the punch member 15 has a section coincident with the upper pattern hole 21 and also has a cutting blade 15*a* formed along an edge at a lower end. In FIG. 3, the punch member 15 having a shape of alphabet 'A' is shown as an example with its lower end upward.

At an upper end of the punch member 15, combined is a cap member 16 an upper surface of which is partially exposed from the upper surface of the housing 10 through the through hole 10*a*. In addition, a marking 16*a* having a shape identical to the sectional pattern of the combined punch member 15, that is, the pattern of the upper pattern hole 21 is formed on the upper surface of the cap member 16 by preferably printing.

Any of the housing 10 and the upper plate 20 is provided with an elastic member 17 to give elastic force to the punch member 15. For this purpose, a projection 21*a* is formed to a portion where the upper pattern hole 21 is formed, as shown in the figures, so that the elastic member 17 of a spring shape may be seated thereon. Of course, the present invention is not limited only to that configuration.

The lower plate 22 is a member, which is preferably integrated with a lower portion of the upper plate 20 with a predetermined gap therebetween so as to insert a sheet material such as paper. On the upper surface of the lower plate 22, formed are a plurality of lower pattern holes 23, which are faced with the upper pattern holes 21 of the upper plate 20 and composed of holes having patterns identical to those of the upper pattern holes 21. At this time, the present invention is not limited to such configuration that the upper plate 20 and the lower plate 22 are integrated, of course.

The lower plate 22 is seated on a support plate 30. The support plate 30 is preferably combined with the housing 10 through supports 31 formed at both longitudinal ends thereof. At this time, the support 31 is elongated up to an upper portion of the housing 10. And preferably, combining holes 31*a* are formed at both supports 31 for combination with the guide rail 7.

The guide rail 7 positioned at an upper portion of the housing 10 along its longitudinal direction preferably has a rod shape to which the push handle 5 is combined so as to slide along a longitudinal direction of the guide rail 7. At this time, it is also preferred to install a hinge 5*a* under the push handle 5 so that the push handle 5 may not only slide but also pivot on the axis of the guide rail 7.

Figure 4:
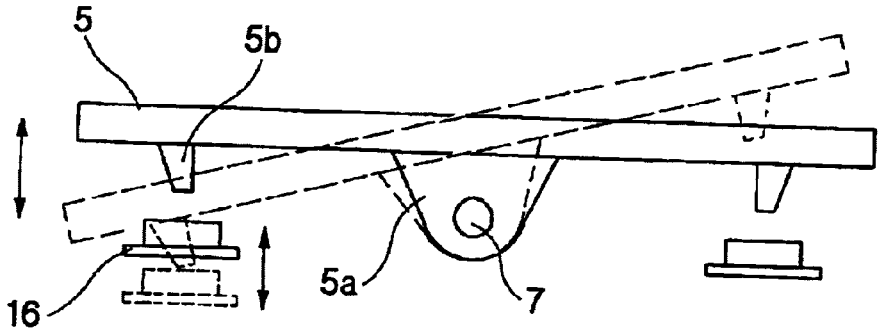
FIG. 4 is a schematic diagram for illustrating a state that a push handle positioned upon a cap member is rotated by pressure to press the cap member.

Since the push handle 5 is pivotable as described above, the cap member 16 is pressed by pushing one side of the push handle 5 on the center of the guide rail 7. In other words, by pressing one side of the push handle 5 in the state that the push handle 5 is positioned above the specific cap member 16 as shown in FIG. 4, the cap member 16 is pressed. At this time, it is also preferable to form a push protrusion 5*b* at a lower surface of the push handle 5 in order to press the upper surface of the cap member 16 more effectively when the push handle 5 is pressed down. Since the punch member 15 is combined at a lower end of the cap member 16 as described above, the pressed punch member 15 slides and descends through the upper pattern hole 21 and the lower pattern hole 23

Preferably, a protrusion 6*a* is provided to a lower portion of the hinge 5*a* of the push handle 5 in bar of shaking when the push handle 5 is positioned above the cap member 16.

For that reason, there is provided a support member 6 of which an upper end is hinged to the hinge 5*a* of the push handle 5 and a lower end is seated on a longitudinal groove 32 formed on the support plate 30 so as to support the protrusion 6*a*. And preferably, catch grooves 11*a* are formed to an inner wall of the guide groove 11 at a constant interval corresponding to each cap member 16 so that the protrusion 6*a* may be fixed to the catch groove 11*a*.

In addition, an elastic member 6*b* is installed to the support member 6 to give elastic force to the protrusion 6*a* so that the protrusion 6*a* may contact with the catch groove 11*a* with elasticity and thus the protrusion 6*a* may be easily released from the catch groove 11*a* during movement of the push handle 5.

Now, an example of application of the present invention as described above is described.

First of all, in order to use the device according to the present invention, the push handle 5 above the housing 10 is moved along the guide rail 7 and then positioned on the cap member 16 having a desired pattern to be punched. At this time, the protrusion 6*a* under the push handle 5 is elastically contacted with the inner wall of the guide groove 11 and then caught at the catch groove 11*a* to prevent shaking during the punching operation.

Then, the sheet material to be punched such as paper is interposed between the upper plate 20 and the lower plate 22, the push handle 5 is then pushed so that the pushing force is transmitted to press the punch member 15 through a push protrusion 5*b* and the cap member 16, and then the punch member 15 passes through the upper pattern hole 21, the sheet material to be punched and the lower pattern hole 23 in order for the punching operation.

By the present invention, punching operation for various letters and figures can be achieved by using only one punching device, cost effectively and advantageously a user may select a desired pattern to be punched according to taste or requirement of the user only with that device.

Particularly, the present invention is very practical since all of alphabet letters can be punched with one device, when designed for that purpose.

The device for blanking out patterns according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A device for blanking out patterns, comprising:

a housing in a predetermined shape having a guide groove formed along a longitudinal direction of an upper surface thereof and a plurality of through holes arranged at both sides of a center of the guide groove, the guide groove having catch grooves which are formed on an inner wall of the guide groove at a constant interval along the longitudinal direction;

an upper plate positioned under the housing and having upper pattern holes of a predetermined shape faced with the through holes;

a lower plate combined to the upper plate with a predetermined gap and having a plurality of lower pattern holes faced with the upper pattern holes of the upper plate respectively;

a punch member having a cutting blade at a lower end along an edge thereof and interposed between the through hole of the housing and the upper pattern hole of the upper plate to be slidable through the upper pattern hole;

a first elastic member to give elastic force to the punch member toward any of the housing and the upper plate;

a cap member combined to an upper end of the punch member, an upper surface of the cap member being partially exposed from the housing through the through hole, a marking with same shape as the upper pattern hole being formed on the upper surface of the cap member;

a guide rail installed to an upper portion of the housing along a longitudinal direction thereof;

a push handle combined to the guide rail as a pivot axis to slide along the guide rail to cress the cap member by rotation and having a protrusion of which an end is in contact with the catch groove at a lower portion;

a second elastic member to give elastic force to the protrusion; and a support plate combined with the housing to support the upper and lower plates, the support plate including supports which are extended upward above the housing and have combining holes formed at both longitudinal ends to which both ends of the guide rail are combined.

2. The device as claimed in claim 1, wherein a push protrusion is formed at a lower surface of the push handle to press an upper surface of the cap member by rotation.

* * * * *